US010396474B2

(12) United States Patent
Burris et al.

(10) Patent No.: US 10,396,474 B2
(45) Date of Patent: Aug. 27, 2019

(54) COAXIAL CABLE CONNECTOR

(71) Applicant: Corning Optical Communications RF LLC, Glendale, AZ (US)

(72) Inventors: Donald Andrew Burris, Peoria, AZ (US); Thomas Dewey Miller, Peoria, AZ (US)

(73) Assignee: Corning Optical Communications RF LLC, Glendale, AZ (US)

( * ) Notice: Subject to any disclaimer, the term of this patent is extended or adjusted under 35 U.S.C. 154(b) by 0 days.

(21) Appl. No.: 15/777,395

(22) PCT Filed: Oct. 24, 2016

(86) PCT No.: PCT/US2016/058468
§ 371 (c)(1),
(2) Date: May 18, 2018

(87) PCT Pub. No.: WO2017/087124
PCT Pub. Date: May 26, 2017

(65) Prior Publication Data

US 2018/0331437 A1 Nov. 15, 2018

Related U.S. Application Data

(63) Continuation of application No. 14/946,053, filed on Nov. 19, 2015, now abandoned.

(51) Int. Cl.
*H01R 9/05* (2006.01)
*H01R 13/622* (2006.01)
*H01R 43/16* (2006.01)

(52) U.S. Cl.
CPC ..... *H01R 9/0521* (2013.01); *H01R 9/0503* (2013.01); *H01R 13/622* (2013.01); *H01R 43/16* (2013.01)

(58) Field of Classification Search
CPC ... H01R 9/0521; H01R 9/0503; H01R 13/622
(Continued)

(56) References Cited

U.S. PATENT DOCUMENTS 346,958 A 8/1886 Stone
3,671,926 A 6/1972 Nepovim
(Continued)

OTHER PUBLICATIONS

International Search Report of the International Searching Authority; PCT/US2013/070497; dated Feb. 11, 2014; 3 Pages; European Patent Office.

*Primary Examiner* — Alexander Gilman
(74) *Attorney, Agent, or Firm* — Tamika A. Crawl-Bey

(57) ABSTRACT

Connectors and methods for attaching connectors to one or more cables and/or conduits are disclosed. In one example, a coaxial cable connector for connecting a coaxial cable comprising an inner conductor, an insulator layer surrounding the inner conductor, an outer conductor layer surrounding the insulator layer and an outer jacket is provided. The coaxial cable connector includes a front body comprising an opening for receiving at least a portion of a coaxial cable. The front body includes a plurality of rearward facing projections. A back nut sub-assembly includes a back nut and a retainer coupled to the back nut. The back nut is adapted to couple to the front body and the retainer is adapted to receive a least a portion of the coaxial cable. The retainer includes a plurality of forward facing protrusions adapted to engage the plurality of rearward facing protrusions when the back nut is coupled to the front body.

20 Claims, 14 Drawing Sheets

(58) Field of Classification Search
USPC ..... 439/578
See application file for complete search history.

(56) References Cited

U.S. PATENT DOCUMENTS

| | | | | |
|---|---|---|---|---|
| 3,686,623 | A | 8/1972 | Nijman | |
| 3,744,011 | A | 7/1973 | Blanchenot | |
| 3,761,870 | A | 9/1973 | Drezin et al. | |
| 3,854,789 | A | 12/1974 | Kaplan | |
| 3,874,763 | A | 4/1975 | Hoover | |
| 3,879,102 | A | 4/1975 | Horak | |
| 4,285,564 | A * | 8/1981 | Spinner | H01R 13/622 439/321 |
| 4,346,958 | A | 8/1982 | Blanchard | |
| 4,447,107 | A | 5/1984 | Major, Jr. et al. | |
| 4,491,685 | A | 1/1985 | Drew et al. | |
| 4,676,577 | A | 6/1987 | Szegda | |
| 4,823,412 | A | 4/1989 | Spiegel | |
| 4,854,893 | A | 8/1989 | Morris | |
| 4,952,174 | A | 8/1990 | Sucht et al. | |
| 4,964,805 | A | 10/1990 | Gabany | |
| 5,246,379 | A * | 9/1993 | Wright | H01R 13/622 439/320 |
| 5,352,134 | A | 10/1994 | Jacobsen et al. | |
| 6,183,298 | B1 | 2/2001 | Henningsen | |
| 6,331,123 | B1 | 12/2001 | Rodrigues | |
| 6,808,415 | B1 | 10/2004 | Montena | |
| 6,884,113 | B1 | 4/2005 | Montena | |
| 6,884,115 | B2 | 4/2005 | Malloy | |
| 7,351,101 | B1 | 4/2008 | Montena | |
| 7,632,143 | B1 | 12/2009 | Islam | |
| 7,845,980 | B1 | 12/2010 | Amidon | |
| 7,857,661 | B1 | 12/2010 | Islam | |
| 7,892,005 | B2 | 2/2011 | Haube | |
| 7,918,687 | B2 | 4/2011 | Paynter et al. | |
| 7,950,961 | B2 | 5/2011 | Chabalowski et al. | |
| 7,972,176 | B2 | 7/2011 | Burris et al. | |
| 8,075,338 | B1 | 12/2011 | Montena | |
| 8,157,587 | B2 | 4/2012 | Paynter et al. | |
| 8,287,309 | B1 | 10/2012 | Thomas et al. | |
| 8,366,482 | B2 | 2/2013 | Burris et al. | |
| 9,172,157 | B2 | 10/2015 | Burris | |
| 9,246,273 | B2 | 1/2016 | Montet et al. | |
| 9,397,441 | B2 * | 7/2016 | Sun | H01R 13/622 |
| 2003/0194890 | A1 | 10/2003 | Ferderer et al. | |
| 2003/0224657 | A1 * | 12/2003 | Malloy | H01R 9/0521 439/578 |
| 2004/0082218 | A1 | 4/2004 | Stirling | |
| 2005/0085125 | A1 | 4/2005 | Montena | |
| 2005/0277330 | A1 | 12/2005 | Kisling et al. | |
| 2006/0113107 | A1 | 6/2006 | Williams | |
| 2007/0026735 | A1 | 2/2007 | Pyron et al. | |
| 2008/0032556 | A1 | 2/2008 | Schreier | |
| 2008/0176447 | A1 * | 7/2008 | Schmitt | H01R 13/5812 439/606 |
| 2010/0022125 | A1 | 1/2010 | Burris et al. | |
| 2010/0178799 | A1 | 7/2010 | Lee et al. | |
| 2010/0323541 | A1 | 12/2010 | Amidon et al. | |
| 2011/0117776 | A1 * | 5/2011 | Burris | H01R 9/0524 439/578 |
| 2012/0122329 | A1 | 5/2012 | Montena | |
| 2013/0072057 | A1 | 3/2013 | Burris | |
| 2014/0120766 | A1 | 5/2014 | Meister et al. | |
| 2014/0127941 | A1 | 5/2014 | Lu | |
| 2014/0148044 | A1 | 5/2014 | Balcer et al. | |

* cited by examiner

COAXIAL CABLE CONNECTOR

CROSS REFERENCE TO RELATED APPLICATIONS

This application claims the benefit of priority of U.S. patent application Ser. No. 14/946,053, filed Nov. 19, 2015, the content of which is relied upon and incorporated herein by reference in its entirety.

FIELD

The present invention relates generally to coaxial cable connectors, and particularly to connectors for use with hardline coaxial cables.

TECHNICAL BACKGROUND

A hardline coaxial cable typically has a solid center conductor surrounded by a plastic or other dielectric material and encased within an electrically conductive solid outer conductor that may be surrounded by an outer insulative jacket. In application, each end of the cable can be terminated by a connector, which serves to electrically and mechanically engage the cable conductors to communicate signals transmitted therethrough and for gripping the outer conductor to physically secure the cable and prevent detachment during normal operation.

Historically, connectors for hardline coaxial cables have been designed to grip the cable in such a manner as to be removable from the cable at a later time if so desired. Such a feature is generally known as "re-usability." Often, such connectors use a compressible ferrule to grip the cable outer conductor. The ferrules are typically actuated by means of conically ramped components known as compression rings. These compression rings are moved axially closer together by means of a threaded coupler or nut. Rotation of the coupler system can impart a rotational force against the compression rings and be translated through the compression rings to the ferrule. As the ferrule is driven closed about the cable outer conductor the rotational force can then be translated to the cable outer conductor resulting in unwanted rotation or twist of the cable outer conductor in relation to the cable center conductor and connector components causing damage to the coaxial structure. In such connectors it is necessary to attempt to restrain the cable while tightening the connector components which is a difficult proposition given the number of hands available to the typical installer. Two hands are typically required to manipulate the required wrenches and a third hand required to restrain the cable. Additionally, in some connectors it is possible for the cable to rotate within the connector after the connector components have been fully tightened because there is no positive structure to adequately prevent the ferrule from slipping or rotating within the connector structure.

Previous attempts to provide a positive ferrule locking structure within a hardline coaxial cable connector have employed the use of a separate press-fit component resulting in unwanted higher cost and complexity. While other previous methods require a greater number of components, still other previous methods require detailed and expensive machining operations to produce interlocking elements between connector components to prevent the ferrule from slipping or rotating within the connector structure.

To address the aforementioned shortcomings embodiments disclosed herein include a hardline coaxial connector to prevent unwanted rotation or twist of the cable outer conductor in relation to the cable center conductor and connector components and, further, prevent cable rotation within the connector after the connector components have been fully tightened.

SUMMARY

Connectors and methods for attaching connectors to one or more cables and/or conduits are disclosed. Embodiments of coaxial cable connectors that may have a reduced number of components, a support sleeve and are adapted to engage a front body of the connector to a retainer of a back nut sub-assembly to prevent cable rotation during the cable installation process.

Embodiments disclosed herein include a hardline coaxial connector having a plurality of protrusions on each of the front body and the retainer to prevent unwanted rotation or twist of the cable outer conductor in relation to the cable center conductor and connector components and, further, prevent cable rotation within the connector after the connector components have been fully tightened. In some embodiments the protrusions comprise teeth integrally formed with at least one of a connector body and a retainer. The teeth or other protrusions engage or interlock with corresponding features in a retainer.

In one example, a coaxial cable connector for connecting a coaxial cable comprising an inner conductor, an insulator layer surrounding the inner conductor, an outer conductor layer surrounding the insulator layer and an outer jacket is provided. The coaxial cable connector includes a front body comprising an opening for receiving at least a portion of a coaxial cable. The front body includes a plurality of rearward facing projections. A back nut sub-assembly includes a back nut and a retainer coupled to the back nut. The back nut is adapted to couple to the front body and the retainer is adapted to receive a least a portion of the coaxial cable. The retainer includes a plurality of forward facing protrusions adapted to engage the plurality of rearward facing protrusions when the back nut is coupled to the front body.

In another embodiment, a method for securing a cable or conduit in a connector is provided. The method includes inserting a coaxial cable through an inner bore of a back nut cub-assembly. The back nut sub-assembly includes a back nut and a retainer coupled to the back nut. The retainer includes a plurality of forward facing protrusions. The method further includes axially moving the back nut and retainer relative to a front body comprising a plurality of rearward facing protrusions. The rearward facing protrusions of the front body engage the rearward facing protrusions of the retainer to limit rotation of the front body relative to the retainer.

Additional features and advantages will be set forth in the detailed description which follows, and in part will be readily apparent to those skilled in the art from that description or recognized by practicing the embodiments as described herein, including the detailed description which follows, the claims, as well as the appended drawings.

It is to be understood that both the foregoing general description and the following detailed description are merely exemplary, and are intended to provide an overview or framework to understanding the nature and character of the claims. The accompanying drawings are included to provide a further understanding, and are incorporated in and constitute a part of this specification. The drawings illustrate embodiments, and together with the description serve to explain principles and operation of the various embodiments.

BRIEF DESCRIPTION OF THE DRAWINGS

Reference will now be made in detail to various embodiment(s) of a coaxial cable connector, examples of which are illustrated in the accompanying drawings. Whenever possible, the same reference numerals will be used throughout the drawings to refer to the same or like parts.

DETAILED DESCRIPTION

Embodiments of coaxial cable connectors configured to be installed on a coaxial cable are provided. In one embodiment, for example, a coaxial cable connector for connecting a coaxial cable comprising an inner conductor, an insulator layer surrounding the inner conductor, an outer conductor layer surrounding the insulator layer and an outer jacket is provided. The coaxial cable connector includes a front body comprising an opening for receiving at least a portion of a coaxial cable. The front body includes a plurality of rearward facing projections. A back nut sub-assembly includes a back nut and a retainer coupled to the back nut. The back nut is adapted to couple to the front body and the retainer is adapted to receive a least a portion of the coaxial cable. The retainer includes a plurality of forward facing protrusions adapted to engage the plurality of rearward facing protrusions when the back nut is coupled to the front body. In another embodiment, a method for securing a cable or conduit in a connector is provided. The method includes inserting a coaxial cable through an inner bore of a back nut cub-assembly. The back nut sub-assembly includes a back nut and a retainer coupled to the back nut. The retainer includes a plurality of forward facing protrusions. The method further includes axially moving the back nut and retainer relative to a front body comprising a plurality of rearward facing protrusions. The rearward facing protrusions of the front body engage the rearward facing protrusions of the retainer to limit rotation of the front body relative to the retainer.

Figure 1:
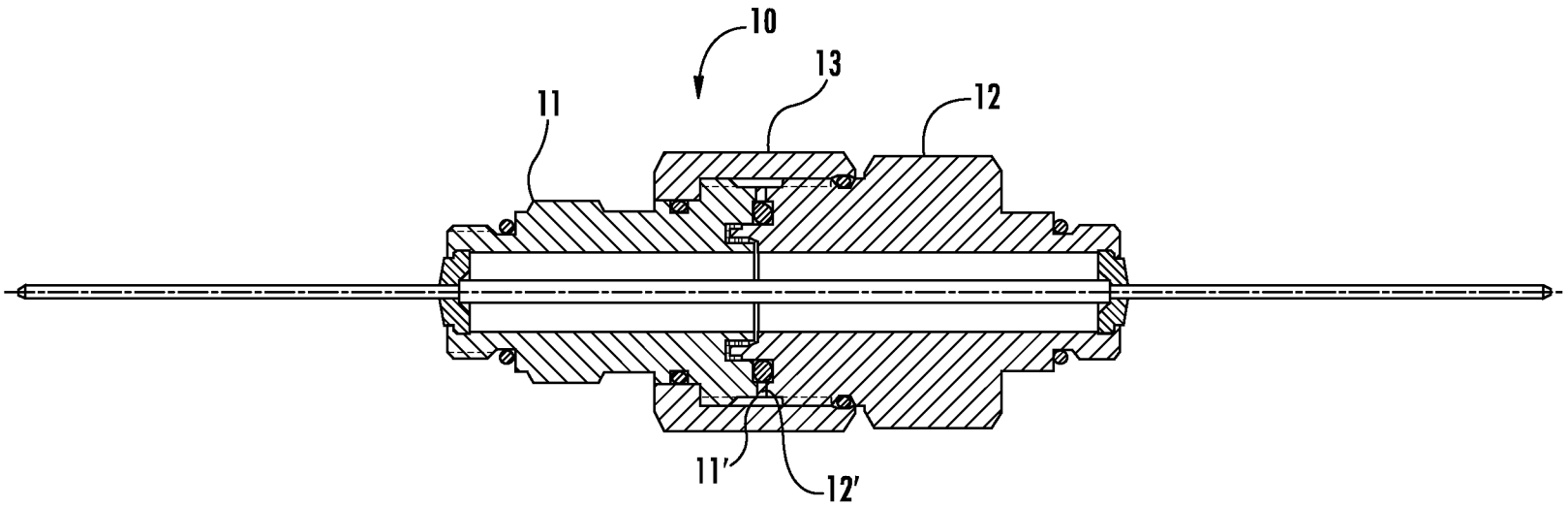
FIG. 1 is a cross section illustration of an example coaxial cable connector.

FIG. 1 schematically depicts a partial cross section of an example coaxial cable connector 10. In this particular example, the coaxial cable connector 10 includes a front body 11 and rear body 12. The front body 11 and the rear body 12 each include a plurality of teeth 11' and 12', respectively. The teeth 11' and 12' serve to rotationally lock the front body 11 and the rear body 12 together when a nut 13 is tightened over a threaded portion of the rear body 12.

Figure 2:
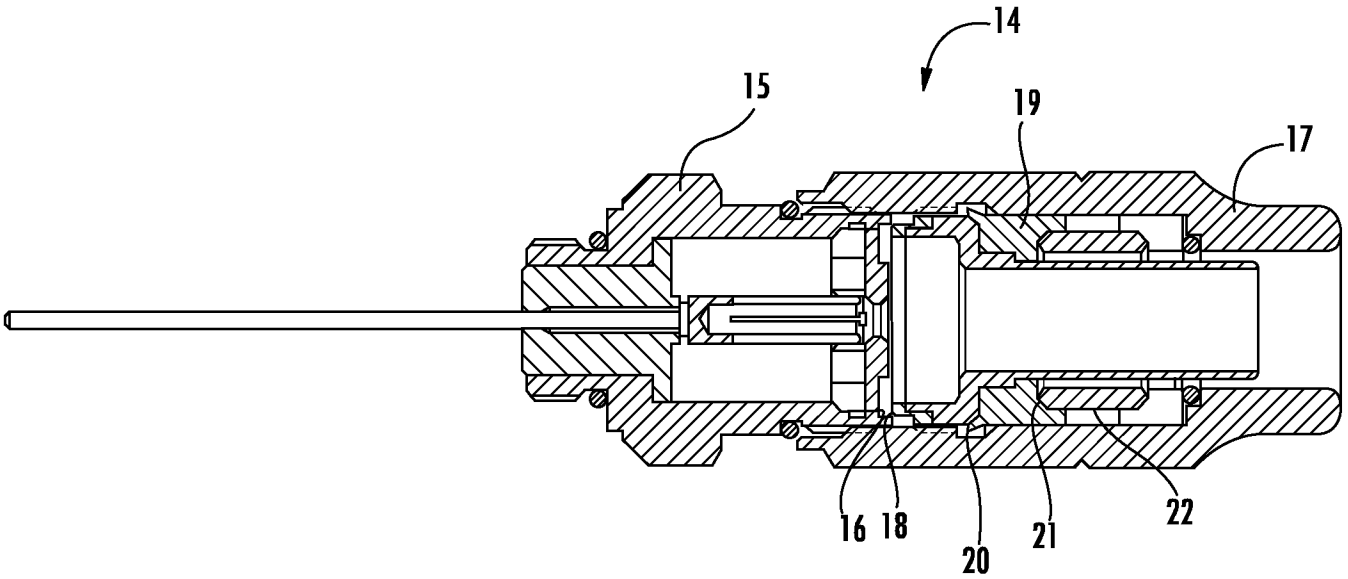
FIG. 2 is a cross section illustration of another example coaxial cable connector.

FIG. 2 schematically depicts a partial cross section of another example coaxial cable connector 14. The coaxial cable connector 14 includes a front body 15 and back nut sub-assembly 17. The front body 15 includes an angled surface 16. The back nut sub-assembly 17 includes a knurled surface 18 opposing the angled surface 16 of the front body 15. The back nut sub-assembly 17 further includes a compression ring 19 having a 360 degree flared portion 20, an angled surface 21 and a ferrule 22. When the back nut sub-assembly 17 is threadedly advanced onto body 15, the knurled surface 18 of the back nut sub-assembly 17 is driven into angled surface 16 of front body 15 to provide resistance against rotation of the internal components of back nut sub-assembly 17. The 360 degree flared portion 20 serves to retain the internal components within back nut sub-assembly 17.

Figure 3:
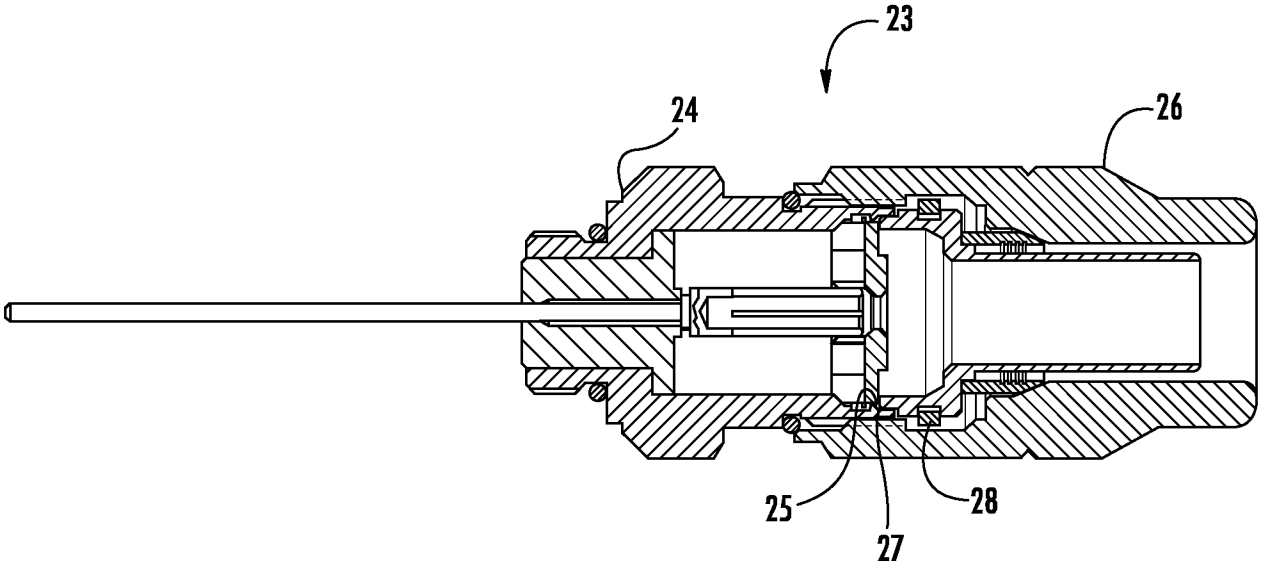
FIG. 3 is a cross section illustration yet another example coaxial cable connector.

FIG. 3 schematically depicts a partial cross section of yet another example coaxial cable connector 23. The coaxial cable connector 23 of FIG. 3 includes a front body 24 and back nut sub-assembly 26, similar to the connector 14 shown in FIG. 2. The front body 24 includes an angled surface 25.

The back nut sub-assembly 26 includes a knurled surface 27 disposed opposite the angled surface 25 of the front body when the front body 25 and back nut sub-assembly 26 are assembled. The back nut sub-assembly 26 further includes a retaining ring 28. When the back nut sub-assembly 26 is threadedly advanced onto front body 24 the knurled surface 27 is driven into the angled surface 25 of front body 24 to provide resistance against rotation of the internal components of back nut sub-assembly 26. The retaining ring 28 serves to retain the internal components within back nut sub-assembly 26.

Figure 4:
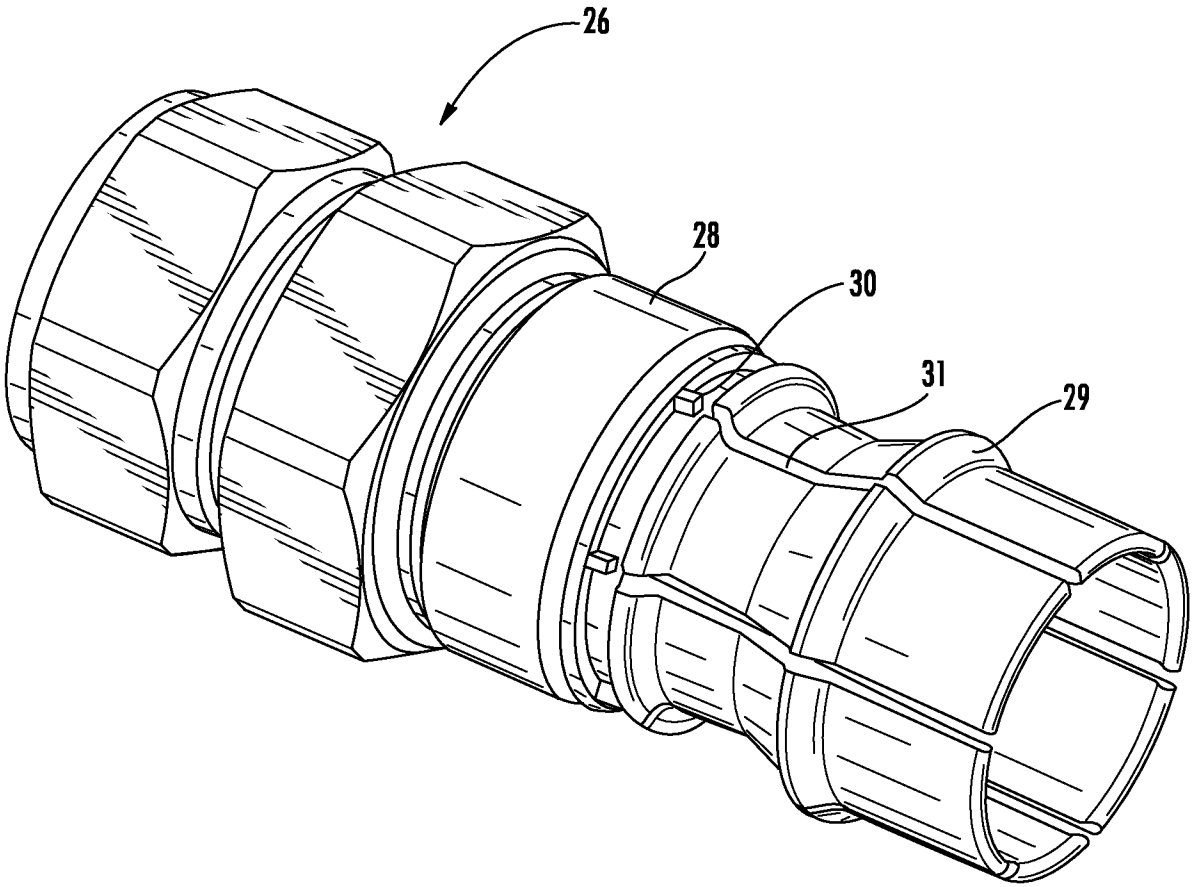
FIG. 4 is a cross section illustration of another example coaxial cable connector.

FIG. 4 schematically depicts a partial cross section of another coaxial cable connector 26 including a front body 28 and a self-locking ferrule 29. The front body 28 includes a plurality of protrusions 30 extending rearwardly that extend into opposing axially extending channels or slots 31 of the ferrule 29. The protrusions 30 of the front body 28 engage one or more surface of the ferrule 29 and prevent the ferrule 29 from rotating with respect to the front body 28 when the protrusions 30 of the front body are engaged with the axially extending channels or slots 31 of the ferrule 29.

Figure 5:
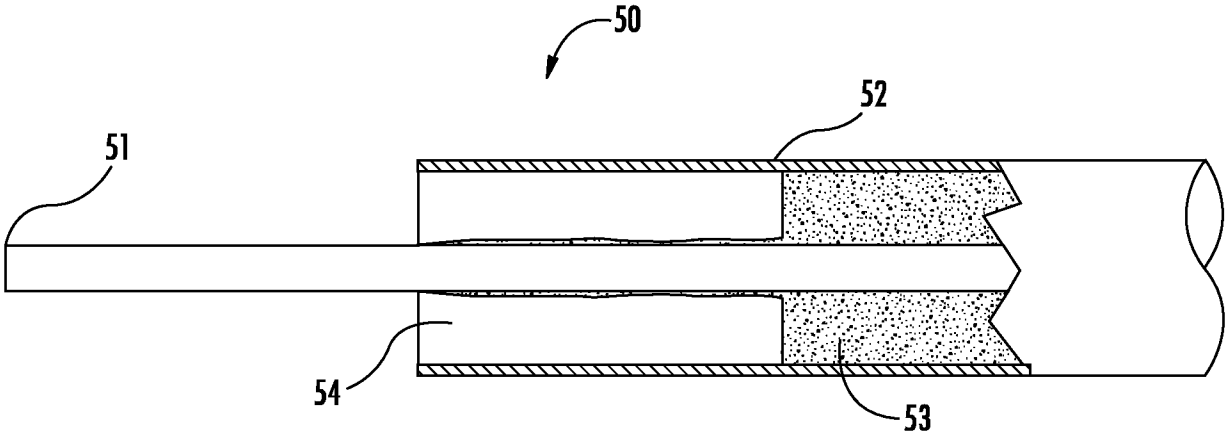
FIG. 5 is a partial cross section view of a hardline coaxial cable prepared for installation according to one or more embodiments described and illustrated herein.

FIG. 5 schematically depicts a partial cutaway and partial cross section view of an example hardline coaxial cable 50 prepared for installation. The hardline coaxial cable 50 includes an inner or center conductor 51 surrounded by a dielectric/insulator layer 53. In some embodiments the inner conductor 51 is copper-clad aluminum, though the inner conductor 51 may be a conductor other than copper-clad aluminum (e.g., copper, gold, or the like) in other embodiments. In some embodiments, the dielectric/insulator layer 53 is a plastic, though the insulator layer 53 may be an insulator other than plastic in other embodiments. The insulator layer 53 may also have a foil or other metallic covering in some embodiments. The coaxial cable 50 further comprises an outer conductor layer 52 which is covered and protected by an outer layer (i.e., a cable jacket). The outer conductor layer 52 may, for example, comprise a braided and/or foil outer conductor layer. In some embodiments, the covering and the outer conductor layer 52 is aluminum, though the covering and/or the outer conductor layer 52 may be a conductor other than aluminum in other embodiments. In some embodiments, the outer jacket is an insulator, such as, but not limited to plastic. The outer jacket may comprise, for example, polyethylene and/or other plastic.

In the particular example shown in FIG. 5, the inner conductor 51 is at least partially exposed and the insulator material 53 is at least partially removed or cored using industry standard tools and techniques leaving cored area 54 to accept a connector support sleeve.

Figure 6:
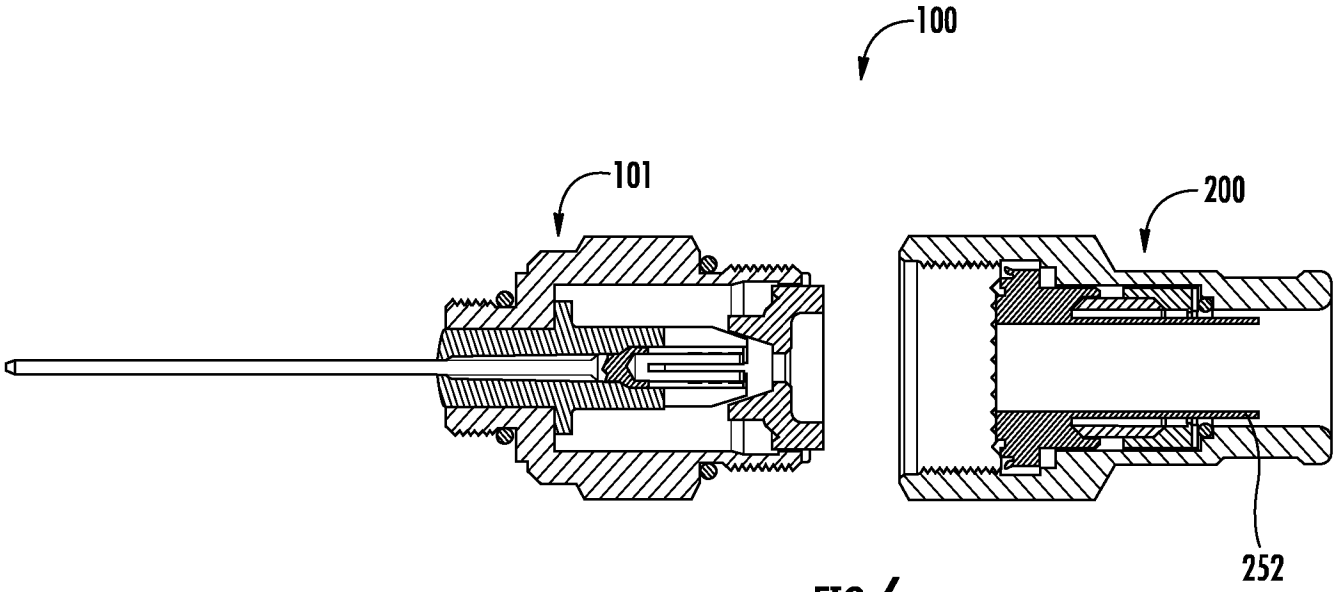
FIG. 6 is a cross section illustration of an embodiment of an example coaxial cable connector in a sub-assembly state according to one or more embodiments described and illustrated herein.
Figure 7:
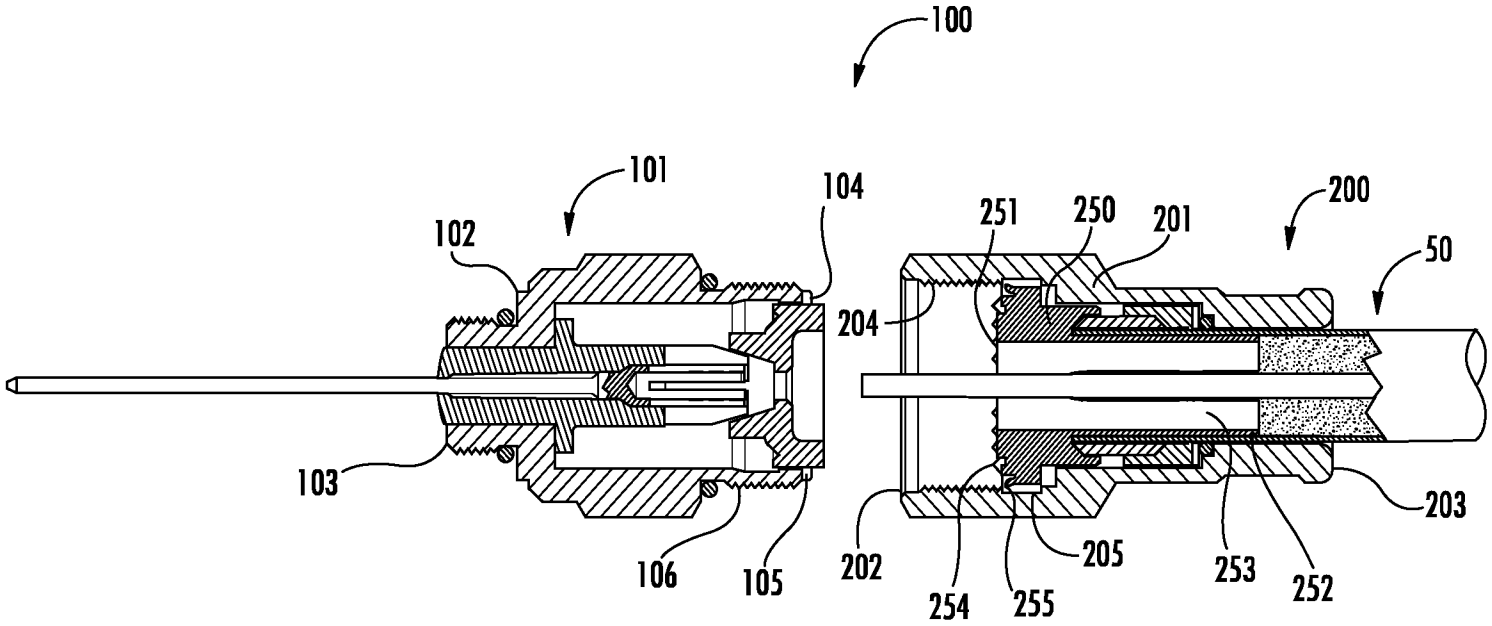
FIG. 7 is a cross section illustration of the embodiment of the coaxial cable connector of FIG. 6 in a further sub-assembly state where the cable from FIG. 5 is inserted into one of the sub-assemblies according to one or more embodiments described and illustrated herein.
Figure 8:
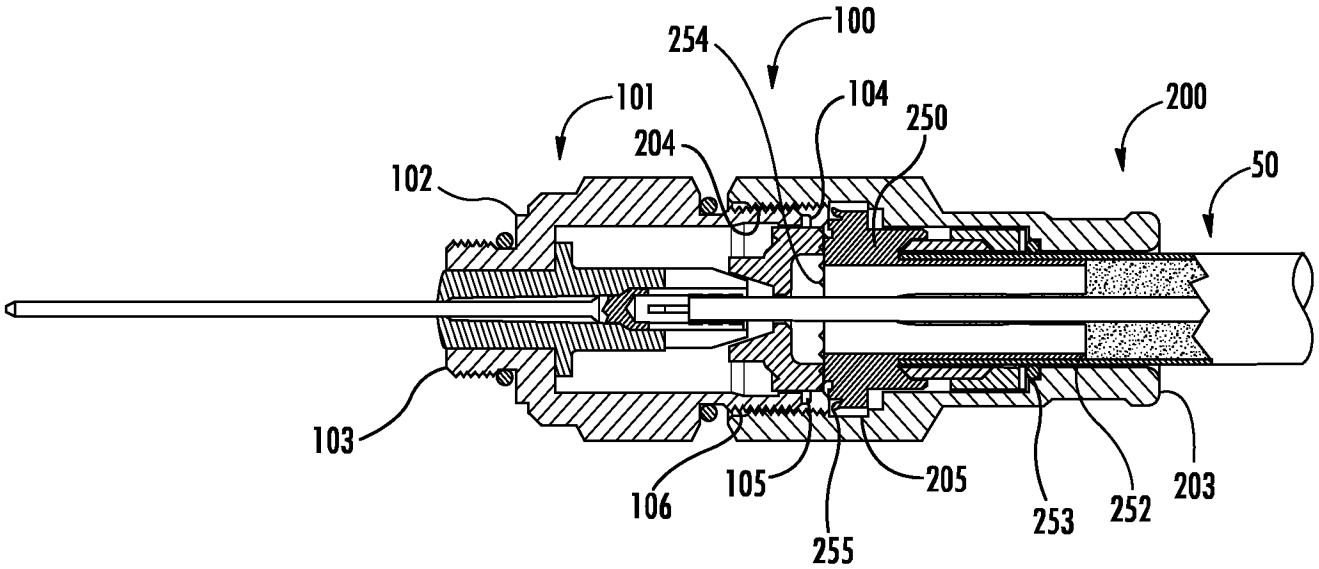
FIG. 8 is a cross section illustration of the embodiment of the coaxial cable connector of FIGS. 6 and 7 in a further sub-assembly state where the cable from FIG. 5 is inserted into one of the sub-assemblies and the two sub-assemblies are loosely threaded together according to one or more embodiments described and illustrated herein.
Figure 9:
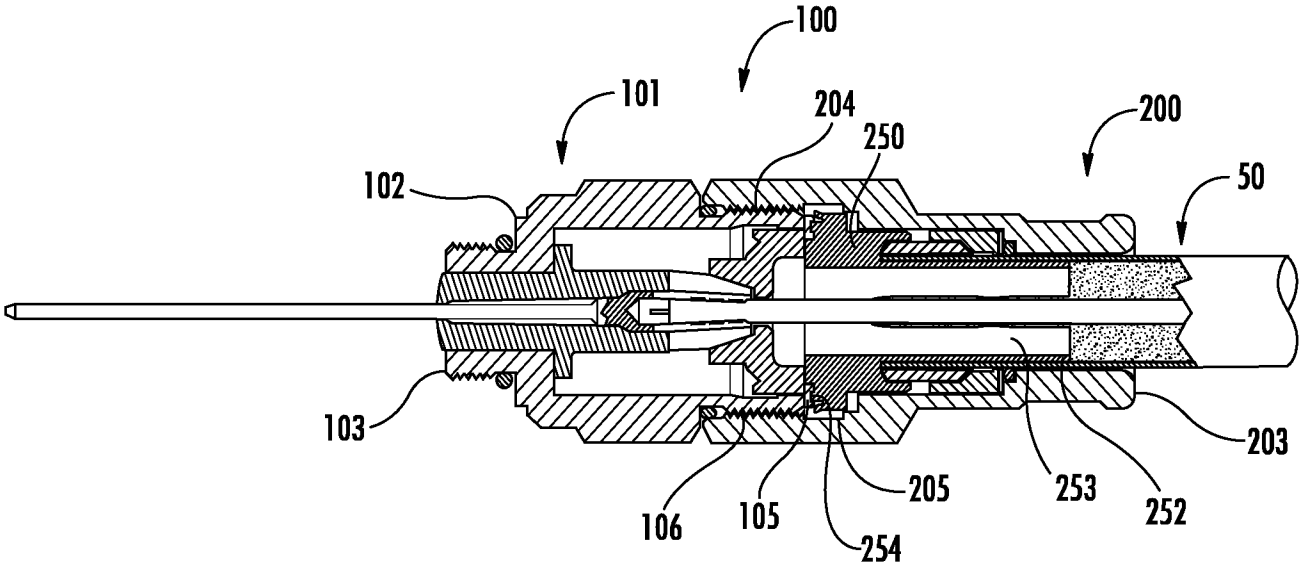
FIG. 9 is a cross section illustration of the embodiment of the coaxial cable connector of FIGS. 6, 7 and 8 in an assembled state where the cable from FIG. 5 is inserted into one of the sub-assemblies and the two sub-assemblies are threaded together and fully tightened according to one or more embodiments described and illustrated herein.

FIGS. 6-9 schematically depict partial cross section views of a coaxial cable connector 100 from a first disassembled state shown in FIG. 6 to partially assembled states (e.g., FIGS. 7 and 8) to a fully assembled state shown in FIG. 9.

FIG. 6 schematically depicts a partial cross section view of the coaxial cable connector 100 in a first disassembled state. In FIG. 6, the connector 100 includes a front body sub-assembly 101 and a back nut sub-assembly 200. In FIG. 2, the front body sub-assembly 101 and the back nut sub-assembly 200 of the coaxial cable connector 100 are not yet assembled.

FIG. 7 schematically depicts a partial cross section view of the coaxial connector 100 shown in FIG. 6 in a sub-assembly state in which a prepared coaxial cable, such as the prepared coaxial cable 50 shown in FIG. 5, is inserted into the back nut sub-assembly 200. In this embodiment, for example, the front body sub-assembly 101 includes a front body 102 having a front end 103 and a back end 104. The front body 102 further includes a plurality of teeth 105 and a threaded portion 106 in which a plurality of threads extend from an outer surface of the front body 102 near the back end 104 of the front body 102. The back nut sub-assembly 200 includes a back nut 201 having a front end 202 and a back end 203. The back nut sub-assembly 200 further includes a threaded portion 204 in which a plurality of threads extend from an inner surface of the back nut 201 that defines an opening extending through the back nut 201. The threaded portion 204 of the back nut 201 is adapted to mate with the threaded portion 106 of the front body 102 to engage the front body 102 to the back nut 201. A recess 205 is formed along the inner surface defining the opening extending through the back nut 201. The recess 205, in one embodiment, for example, may comprise a circumferential channel formed along the inner surface of the back nut 201.

The back nut sub-assembly 200 further comprises a retainer 250 having a front end 251, a back end 252, a through bore 253, a plurality of teeth 254 and a plurality of flared retaining lugs 255.

Assembly of the back nut sub-assembly 200 is accomplished by installing the internal components as illustrated in FIG. 7 and then flaring the plurality of retaining lugs 255 into the undercut/recess 205 using an assembly tool. Flaring the plurality of retaining lugs 255 into the undercut/recess provides limited axial and radial movement of the internal components within the back nut 201, keeps the components in their positioning relative to each other and prevents the components from falling out of the back nut sub-assembly 200.

FIG. 8 schematically depicts a partial cross section view of the coaxial cable connector 100 shown in FIGS. 6 and 7 in a subsequent sub-assembly state. In FIG. 8, the prepared coaxial cable 50 is inserted into the back nut sub-assembly 200 and the front body sub-assembly 101 and the front body sub-assembly 101 and the back nut sub-assembly 200 are loosely threaded together. Teeth 105 of the front body 102 and the teeth 254 of the retainer 250 are not yet engaged and, thus, the front body 102 and the retainer 250 are able to rotate relative to one another.

FIG. 9 schematically depicts another partial cross section view of the coaxial cable connector 100 shown in FIGS. 6 through 8 in another subsequent sub-assembly state. In FIG. 9, the prepared coaxial cable 50 shown in FIG. 5 is inserted into one of the front body sub-assembly 101 and the back nut sub-assembly 200. The front body sub-assembly 101 and the back nut sub-assembly 200 are threaded together and fully tightened. As threaded portion 204 of back nut is advanced over threaded portion 106 of front body 102, the teeth 105 of the front body 102 and the teeth 254 of the retainer 250 are engaged. Once engaged, the teeth 105 of the front body 102 and the teeth 254 of the retainer 250 serve to couple the retainer 250 to the front body 102 preventing appreciable rotational movement between the retainer 250 and the front body 102. This allows the back nut 201 to continue to rotate relative to the retainer 250. Rotational forces that may be exerted by other internal components are arrested by fixing the retainer 250 to the front body 102 as described. This positive interlocking system of the engaging teeth can be more effective than connectors suing small tapered knurls and the like as described above with reference to FIG. 2 and FIG. 3. It can also be less expensive to produce than the connector shown in FIG. 4 requiring fewer components and use simplified machining methods and can be further differentiated by interlocking a retainer to a body instead of interlocking a ferrule to a body. Further, the coaxial cable connector 100 is differentiated from the coaxial cable connector 10 shown in FIG. 1 by interlocking a body to a retainer as opposed to interlocking two bodies.

After coupling two connector sub-assemblies and securing a coaxial cable it is sometimes desired to remove the connector and separate it from the cable for purposes of system maintenance. In some two-piece connector systems this can be difficult because the cable is firmly clamped onto a connector support sleeve. The connector support sleeve and the cable are free to rotate as a unit within the connector back nut and there is no means to apply required torsional force between said support sleeve and cable in order to separate them. The coaxial able connector 100, in contrast provides torsional force between a support sleeve and a cable in order to separate them. For example, in some embodiments, the threaded portion 204 of the back nut 201 may be loosened from the threaded portion 106 of the body 102 enough to allow the internal components of the back nut sub-assembly 200 to relax into an uncompressed state. The teeth 105 of the front body 102 and the teeth 254 of the retainer 250 are still at least partially engaged. With the coaxial cable 50 fixed by hand or other device such as but not limited to a tool, torque may then be applied to the front body 102 using the front body 102 to rotationally drive the retainer 250 relative to the coaxial cable 50 thus breaking a clamping bond between the retainer 250 and the coaxial cable 50 facilitating removal of the coaxial cable 50 from the connector. In short, the front body 102 may be used as a driver tool to rotate the retainer 250 relative to the coaxial cable 50 when utilized in this manner.

Figure 10:
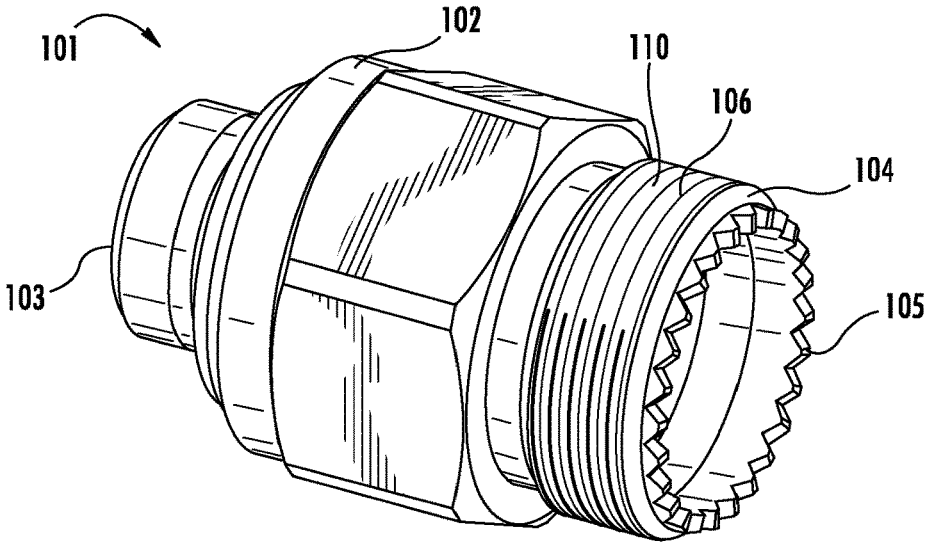
FIG. 10 is cross section illustration of an example embodiment of a front body that may be used within a coaxial cable connector such as the one shown in FIGS. 6-9 according to one or more embodiments described and illustrated herein.

FIG. 10 depicts a perspective view of an example embodiment of a front body 101, such as shown in FIGS. 6-9. As described above with respect to FIGS. 6-9, the front body 102 includes a front end 103 and a back end 104. The front body 102 further includes a plurality of teeth 105 and a threaded portion 106 in which a plurality of threads extend from an outer surface 110 of the front body 102 near the back end 104 of the front body 102.

Figure 12:
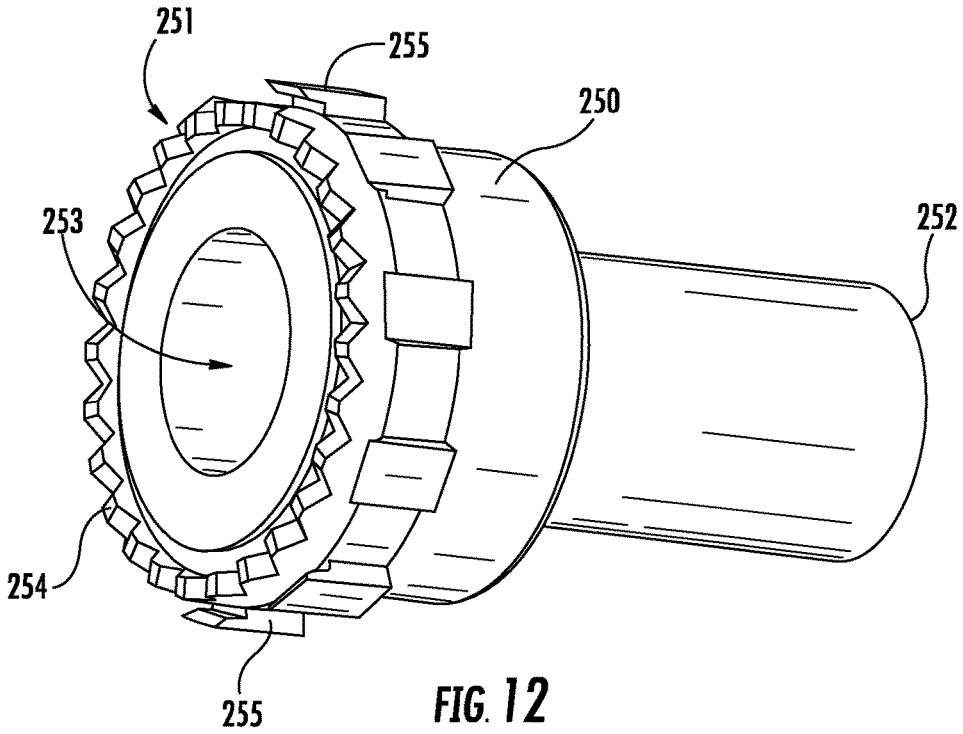
FIG. 12 is cross section illustration of an example embodiment of a retainer of a back nut sub-assembly, such as the back nut sub-assembly shown in FIG. 11, that may be used within a coaxial cable connector such as the one shown in FIGS. 6-9 according to one or more embodiments described and illustrated herein.

FIG. 12 depicts a perspective view of an example retainer 250, such as shown in FIGS. 6-9. In this embodiment, the retainer 250 includes a front end 251, a back end 252, a through bore 253, a plurality of teeth 254 and a plurality of flared retaining lugs 255. The plurality of teeth 254 are adapted to engage with the plurality of teeth 105 of the front body 101. Each of the plurality of flared retaining lugs 255 is adapted to engage a recess 205 of the back nut 201.

Figure 11:
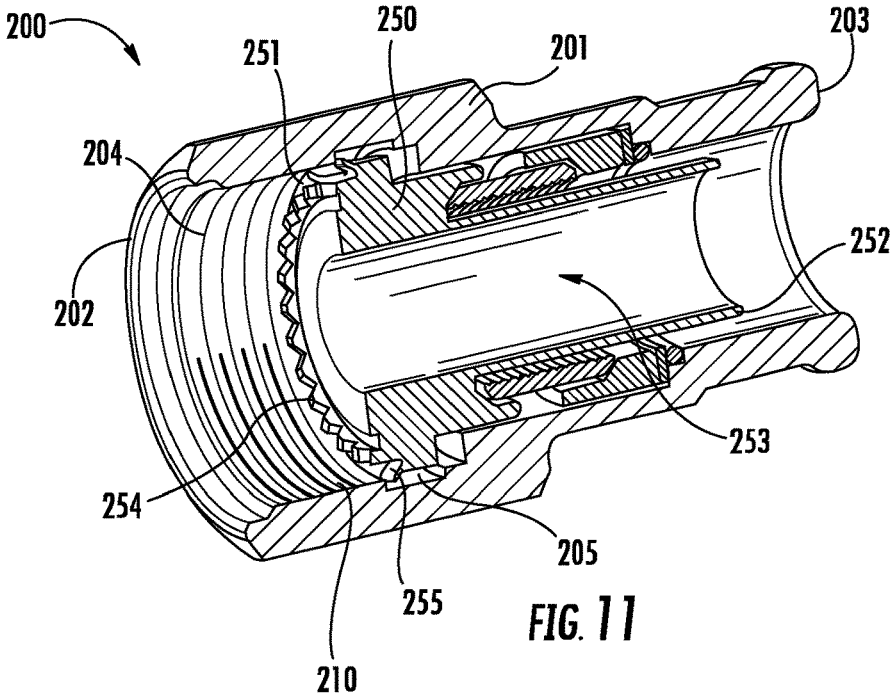
FIG. 11 is cross section illustration of an example embodiment of a back nut sub-assembly including the retainer shown in FIG. 12 that may be used within a coaxial cable connector such as the one shown in FIGS. 6-9 according to one or more embodiments described and illustrated herein.

FIG. 11 depicts a perspective view of an example back nut sub-assembly 200 including the retainer 250 shown in FIG. 12. The back nut sub-assembly 200 includes a back nut 201 having a front end 202 and a back end 203. The back nut sub-assembly 200 further includes a threaded portion 204 in which a plurality of threads extend from an inner surface of the back nut 201 that defines an opening extending through the back nut 201. The threaded portion 204 of the back nut 201 is adapted to mate with the threaded portion 106 of the front body 102 to engage the front body 102 to the back nut 201. A recess 205 is formed along the inner surface defining the opening extending through the back nut 201. The recess 205, in one embodiment, for example, may comprise a circumferential channel formed along the inner surface 210 of the back nut 201.

Figure 13:
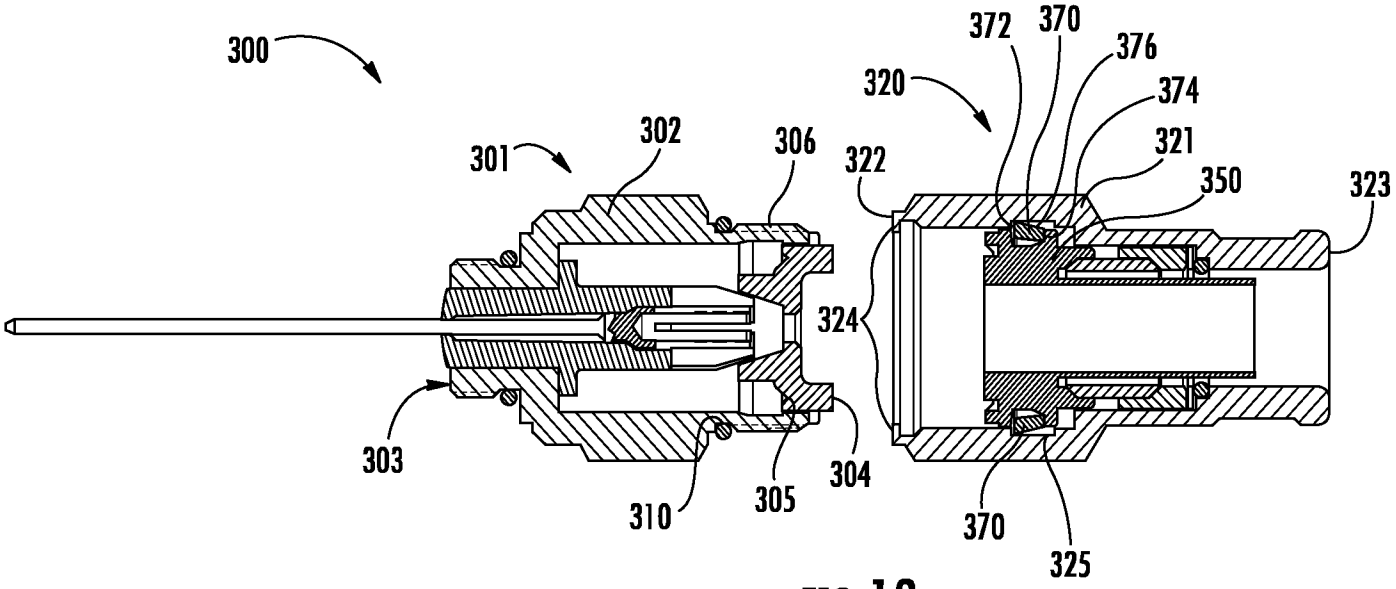
FIG. 13 is a cross section illustration of another example embodiment of an example coaxial cable connector in a sub-assembly state according to one or more embodiments described and illustrated herein.
Figure 14:
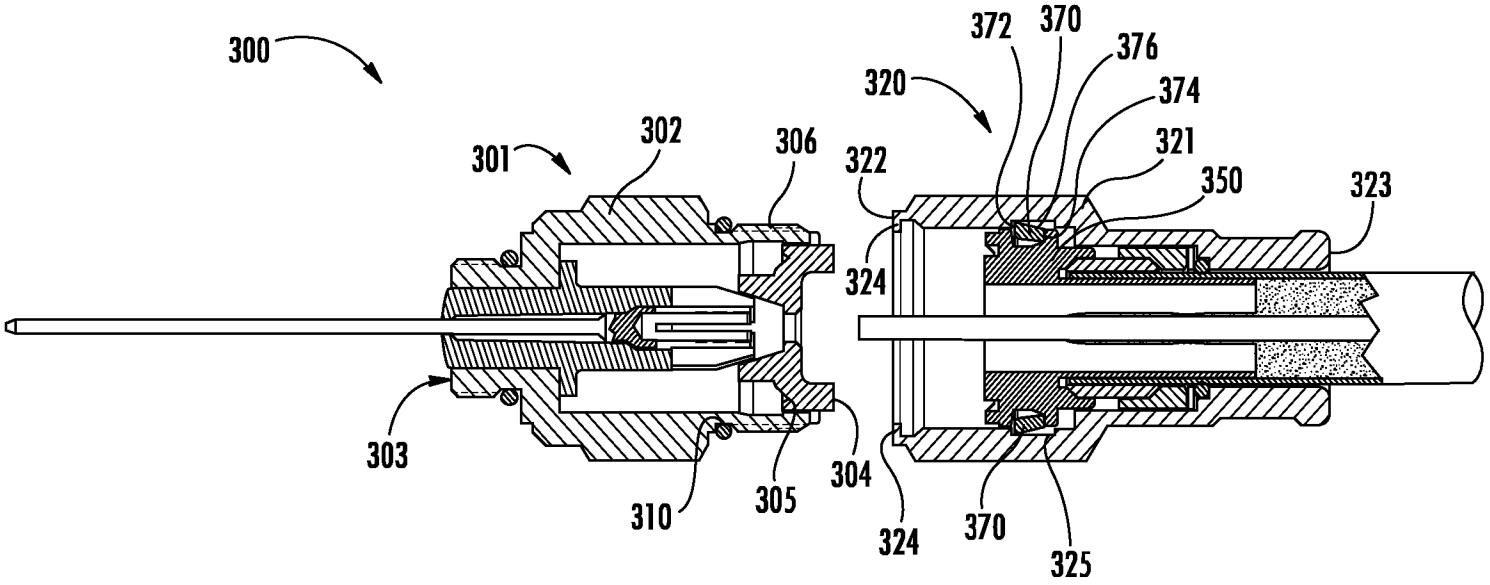
FIG. 14 is a cross section illustration of the embodiment of the coaxial cable connector of FIG. 13 in a further sub-assembly state where the cable from FIG. 5 is inserted into one of the sub-assemblies according to one or more embodiments described and illustrated herein.
Figure 15:
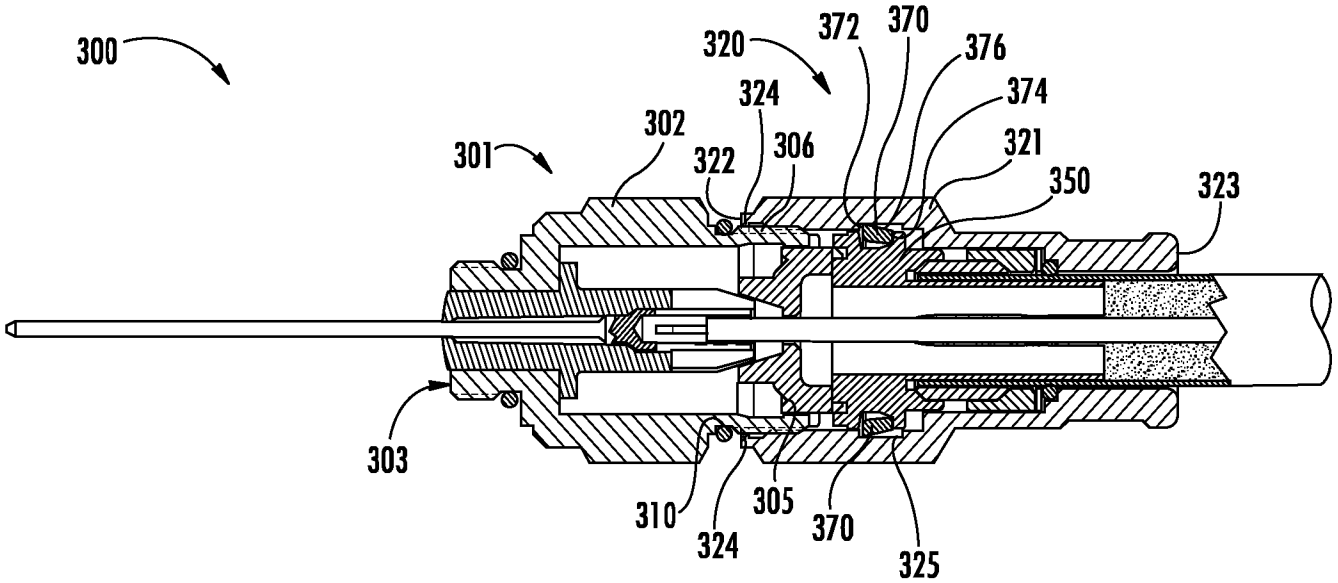
FIG. 15 is a cross section illustration of the embodiment of the coaxial cable connector of FIGS. 13 and 14 in an assembled state where the cable from FIG. 5 is inserted into one of the sub-assemblies and the two sub-assemblies are snap-fit together according to one or more embodiments described and illustrated herein.

FIGS. 13-15 schematically depict partial cross section views of another coaxial cable connector 300 from a first disassembled state shown in FIG. 13 to a partially assembled state shown in FIG. 14 to a fully assembled state shown in FIG. 15.

FIG. 13 schematically depicts a cross section view of a snap-fit example embodiment of a coaxial cable connector 300. In this embodiment, for example the coaxial cable connector 300 comprises a front body sub-assembly 301 including a front body 302, a back nut sub-assembly 320 including a back nut 321 and a retainer 350. The front body 302 includes a front end 303 and a back end 304. The front body 302 further includes a plurality of teeth 305 and at least one protrusion or raised shoulder 306 extending from an outer surface 310 of the front body 302 near the back end 304 of the front body 302. The at least one protrusion or shoulder 306 is adapted for snap-fitting with the back nut 321.

The back nut 321 includes a front end 322 and a back end 323. The back nut 321 further includes at least one inwardly facing radial protrusion 324 extending from an inner surface of the back nut 321. The at least one inwardly facing radial protrusion 324 is adapted to snap fit over the at least one protrusion or raised shoulder 306 of the front body 302. A recess 325 is formed along an inner surface defining an opening extending through the back nut 321. The recess 325, in one embodiment, for example, may comprise a circumferential channel formed along the inner surface 330 of the back nut 321.

As shown in FIG. 13, a ring 370 is snap fit onto the retainer 350 and extends into the recess 325 of the back nut 321 to limit axial movement of the retainer 350 relative to the back nut 321 of the coaxial cable connector 300. The ring 370, in the particular embodiment shown in FIGS. 13-15, comprises a C-shaped tapered cone and is disposed around the retainer 350 and within the recess or channel 325 of the back nut 321. The ring 370 includes a front end 372, a back end 374 and an external taper 376. The external taper 376 in this example is arranged such that an outside diameter of the ring 370 decreases in diameter between the front end 372 and the back end 374 of the ring 370. The ring 370 engages the recess 325 at a forward facing rear surface and a rearward facing forward surface of the recess 325. In one example embodiment, the ring 370 may be made of a metallic material, such as heat treated beryllium copper although other conductive or non-conductive materials may also be used. As the back nut 321 is axially moved toward the front body 302 and snap fit into place, the forward facing rear surface of the recess 325 engages the ring 370, which in turn engages the rearward facing surface of a groove of the retainer 350 driving the retainer 350 forward so that teeth 354 of the retainer 350 engage the teeth 305 of the front body 302.

FIG. 14 schematically depicts a partial cross section view of the snap-fit coaxial cable connector 300 shown in FIG. 13 in a sub-assembly state in which a prepared coaxial cable, such as the prepared coaxial cable 50 shown in FIG. 5, is inserted into the back nut sub-assembly 320. In this implementation, a center conductor of the coaxial cable 50 is inserted into an internal bore of the retainer 350 and an outer conductor layer of the coaxial cable 50 is disposed over the back end of the retainer 350.

FIG. 15 schematically depicts a partial cross section view of the snap-fit coaxial cable connector 300 shown in FIGS. 13 and 14 in an assembled state with the prepared coaxial cable 50 inserted into the retainer 350 of the back nut sub-assembly 320 of the coaxial cable connector as shown in FIG. 14. In this embodiment, the front body sub-assembly 301 is snap fit to the back nut sub-assembly 320, such as via the at least one inwardly facing radial protrusion 324. As described above, the inwardly facing radial protrusion 324, in this assembled coaxial cable connector configuration, is snap fit over the at least one protrusion or raised shoulder 306 of the front body 302. The teeth 305 of the front body sub-assembly 305 engage with teeth 354 of the back nut sub-assembly 320. Once engaged, the teeth 305 of the front body sub-assembly 301 and the teeth 354 of the retainer 350 serve to couple the retainer 350 to the front body 302 preventing appreciable rotational movement between the retainer 350 and the front body 302. This allows the back nut 321 to continue to rotate relative to the retainer 350. Rotational forces that may be exerted by other internal components are arrested by fixing the retainer 350 to the front body 302 as described.

It should now be understood that embodiments described herein are directed to connectors and methods for securing an outer layer of a cable or conduit within a coaxial cable connector.

For the purposes of describing and defining the subject matter of the disclosure it is noted that the terms "substantially" and "generally" are utilized herein to represent the inherent degree of uncertainty that may be attributed to any quantitative comparison, value, measurement, or other representation.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that any particular order be inferred.

It will be apparent to those skilled in the art that various modifications and variations can be made without departing from the spirit or scope of the disclosure. Since modifications, combinations, sub-combinations and variations of the disclosed embodiments incorporating the spirit and substance of the disclosure may occur to persons skilled in the art, the embodiments disclosed herein should be construed to include everything within the scope of the appended claims and their equivalents.

What is claimed is:

1. A coaxial cable connector for connecting a coaxial cable, comprising an inner conductor, an insulator layer surrounding the inner conductor, an outer conductor layer surrounding the insulator layer and an outer jacket, the coaxial cable connector comprising:

a front body comprising an opening for receiving at least a portion of a coaxial cable, the front body comprising a first threaded portion and a plurality of rearward facing projections; and a back nut sub-assembly comprising a back nut, including a second threaded portion and a retainer coupled to the back nut, the second threaded portion being adapted to mate with the first threaded portion and couple the back nut to the front body and the retainer being adapted to receive a least a portion of the coaxial cable, the retainer comprising a plurality of forward facing protrusions adapted to engage the plurality of rearward facing protrusions when the back nut is coupled to the front body and prevent rotational movement between the retainer and the front body while allowing relative rotation of the back nut to the retainer.

2. The connector of claim 1, wherein the plurality of rearward facing protrusions of the front body comprise a plurality of rearward facing teeth.

3. The connector of claim 2, wherein the plurality of forward facing protrusions of the retainer comprise a plurality of forward facing teeth adapted to engage the plurality of rearward facing teeth.

4. The connector of claim 1, wherein the back nut comprises a recess formed at an inner surface of the back nut.

5. The connector of claim 4, wherein the retainer comprises at least one retaining lug extending into the recess of the back nut.

6. The connector of claim 5, wherein the at least one retaining lug comprises a flared retaining lug.

7. The connector of claim 4, wherein a ring disposed between the back nut and the retainer extends into the recess.

8. The connector of claim 7, wherein the ring further extends within an outer annular groove disposed along an outer surface of the retainer.

9. The connector of claim 8, wherein the ring comprises a C-shaped ring.

10. The connector of claim 8, wherein the ring comprises a C-shaped tapered cone.

11. The connector of claim 8, wherein the ring comprises a decreasing outer diameter extending from a first end to a second end.

12. The connector of claim 11, wherein the first end comprises a front end and the second end comprises a back end.

13. The connector of claim 1, wherein the front body comprises a first threaded portion disposed on an outer surface of the front body and the back nut comprises a second threaded portion disposed on an inner surface of the back nut.

14. The connector of claim 1, wherein the front body comprises a first protrusion extending outwardly from an outer surface of the front body.

15. The connector of claim 14, wherein the back nut comprises a second protrusion extending inwardly from an inner surface of the back nut.

16. The connector of claim 15, wherein the second protrusion of the back nut is adapted to engage the first protrusion of the front body.

17. A method for securing a cable or conduit in a connector, the method comprising:

inserting a coaxial cable through an inner bore of a back nut cub-assembly, the back nut sub-assembly comprising a back nut and a retainer coupled to the back nut, the retainer comprising forward facing protrusions; and axially moving the back nut and retainer relative to a front body comprising a plurality of rearward facing protrusions to engage the rearward facing protrusions of the retainer with the forward facing protrusions of the front body to limit rotation of the front body relative to the retainer while allowing relative rotation of the back nut to the retainer.

18. The method of claim 17, wherein the operation of axially moving the back nut and retainer relative to the front body comprises threadably engaging the back nut with the front body.

19. The method of claim 16 either of claim 16 or 17, wherein operation of moving the back nut and retainer relative to the front body comprises axially sliding the back nut relative to the front body.

20. The method of claim 19, wherein the back nut is coupled to the front body via engagement of at least one outwardly extending protrusion of the front body with at least one inwardly extending protrusion of the back nut.

* * * * *